US008345912B2

(12) United States Patent
Akihiko et al.

(10) Patent No.: US 8,345,912 B2
(45) Date of Patent: Jan. 1, 2013

(54) EARPHONE HAVING UNDER HANGER

(75) Inventors: Hosaka Akihiko, Gyeonggi-do (KR); Jung Hun Kwak, Seoul (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 638 days.

(21) Appl. No.: 12/556,060

(22) Filed: Sep. 9, 2009

(65) Prior Publication Data

US 2010/0086167 A1 Apr. 8, 2010

(30) Foreign Application Priority Data

Oct. 6, 2008 (KR) ..... 10-2008-0097474

(51) Int. Cl.
*H04R 25/00* (2006.01)

(52) U.S. Cl. ..... 381/381; 381/330; 381/375; 381/379; 379/430

(58) Field of Classification Search ..... 379/425, 379/430; 318/381; 381/330, 370, 381, 375, 381/379
See application file for complete search history.

(56) References Cited

U.S. PATENT DOCUMENTS

| | | | | |
|---|---|---|---|---|
| 6,728,387 | B1 * | 4/2004 | Polito et al. | 381/375 |
| 7,123,737 | B2 * | 10/2006 | Ham | 381/381 |
| 2004/0008855 | A1 * | 1/2004 | Ham | 381/381 |

* cited by examiner

*Primary Examiner* — Gerald Gauthier
*Assistant Examiner* — Simon King
(74) *Attorney, Agent, or Firm* — Cha & Reiter, LLC

(57) ABSTRACT

An earphone having an under hanger reduces movement of the earphone from vibrations that occur while a user is typically in motion. The earphone preferably includes: a housing for housing a speaker therein; a protector installed in a front surface of the housing and having a mesh for delivering a sound from the speaker; and an under hanger provided at a lower part of the housing to closely contact along a lower part of the rear side of an earflap of a user. The provision of an under hanger in a lower part of the earphone prevents from being easily separated from a user's ear. Further, by providing an under hanger made of a soft material, as the earphone closely contacts with the user's ear, a sound quality is improved and a wearing feeling of the earphone is improved.

16 Claims, 4 Drawing Sheets

EARPHONE HAVING UNDER HANGER

CLAIM OF PRIORITY

This application claims priority from an application entitled "EARPHONE HAVING UNDER HANGER" filed in the Korean Intellectual Property Office on Oct. 6, 2008 and assigned Serial No. 10-2008-0097474, the contents of which are incorporated herein by reference in its entirety.

BACKGROUND OF THE INVENTION

1. Field of the Invention

The present invention relates to an earphone, and more particularly, to an earphone having an under hanger.

2. Description of the Related Art

In general, in order to view a movie, or to listen to music, users are able to employ various electronic devices, including but in now way limited to a radio, cassette player, compact disk player, MP3 player, and portable multimedia player (PMP). In order to listen to a sound through such an electronic device, a user may use a headset or an earphone so as not to disturb others around them, and to be able to concentrate on the audio/visual material, or at least mask ambient background noise.

The earphone is used by inserting a soft-coated piece into/adjacent a user's ear canal. Earpieces can be generally classified as an open-type earphone, closed-type earphone, or semi-closed type earphone according to a form thereof. It is now more common than ever for a pair of earpieces extend from a common feed, so that the user can listen in stereo and/or reduce background noise that would be heard when only a single earpiece is used.

In general, the earphone is temporarily attached to the user by having the user insert a specially designed portion into an earflap. However when the user moves, for example, when performing an exercise such as jogging, the earphone is easily separated (i.e. backs out) from the user's ear. In order to solve the problem, a fixed part such as an earhook can be formed in a cover of the earphone and is typically arranged along an outer portion of the ear, so that the earphone is not easily separated from the user's ear. However when the user wears such an earphone for a long time period, the user can feel a pain in their ear, and the earphone has a somewhat complicated structure.

Therefore, there is a long-felt need in the art for an earphone having a simple structure that is not easily separated from the user's ear while the user is in motion.

SUMMARY OF THE INVENTION

The present invention provides an earphone that is not easily separated from a user's ear, thereby solving a long-felt need in the art.

In accordance with an exemplary aspect of the present invention, an earphone preferably includes: a housing for housing a speaker therein; a protector installed in a front surface of the housing and having a mesh for delivering a sound from the speaker; and an under hanger provided at a lower part of the housing for substantial contact along a lower part of the rear side of an earflap of a user.

BRIEF DESCRIPTION OF THE DRAWINGS

The above features and advantages of the present invention will be more apparent from the following detailed description in conjunction with the accompanying drawings, in which.

DETAILED DESCRIPTION

Figure 1:
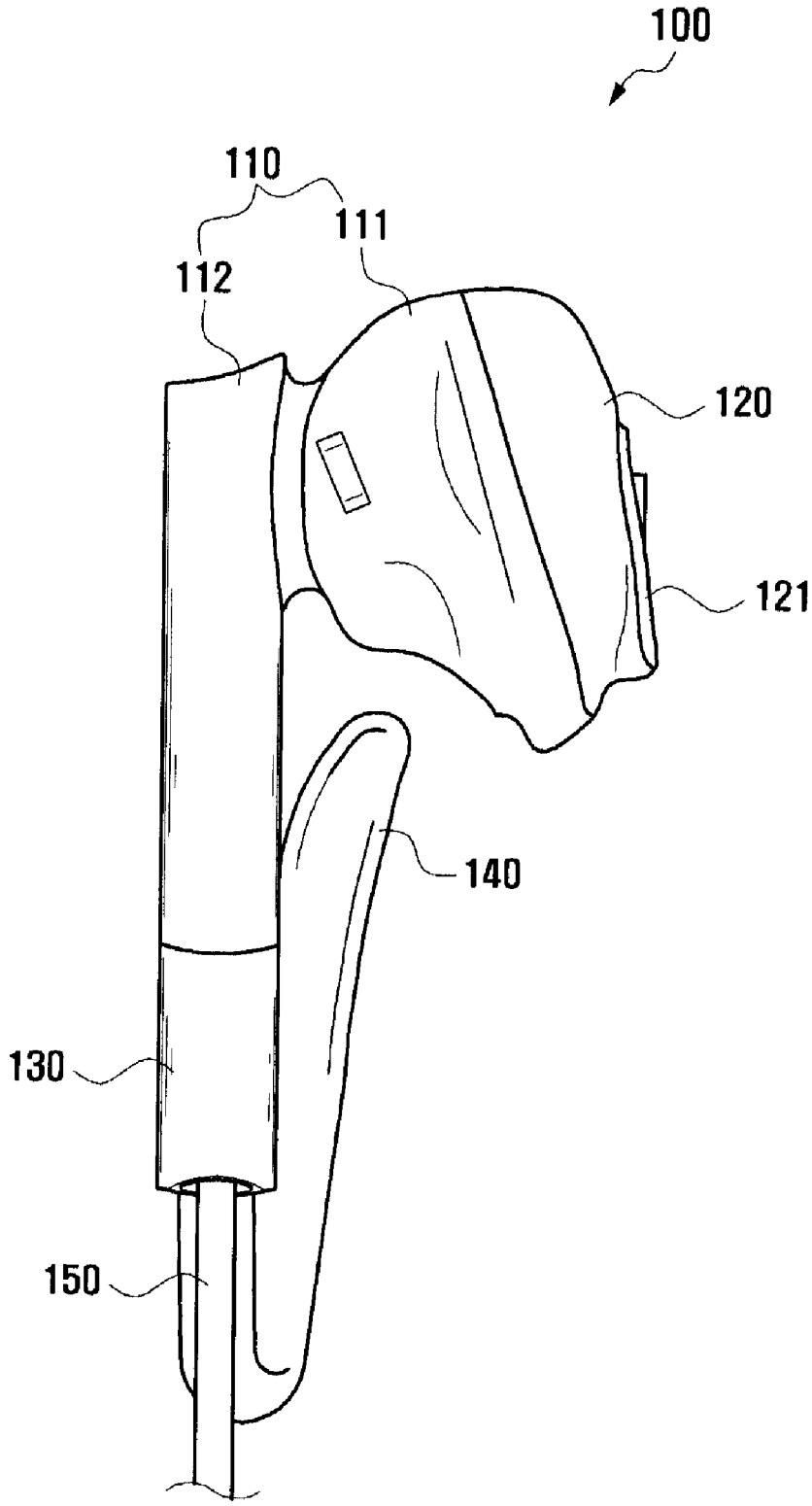
FIG. 1 is a front view illustrating a configuration of an earphone according to an exemplary embodiment of the present invention.

Hereinafter, exemplary embodiments of the present invention are described in detail with reference to the accompanying drawings. The same reference numbers are used throughout the drawings to refer to the same or similar parts. The views in the drawings are schematic views only, and are not intended to be to scale or correctly proportioned. Detailed descriptions of well-known functions and structures incorporated herein may be omitted to avoid obscuring appreciation of the subject matter of the present invention by a person of ordinary skill in the art.

Figure 2:
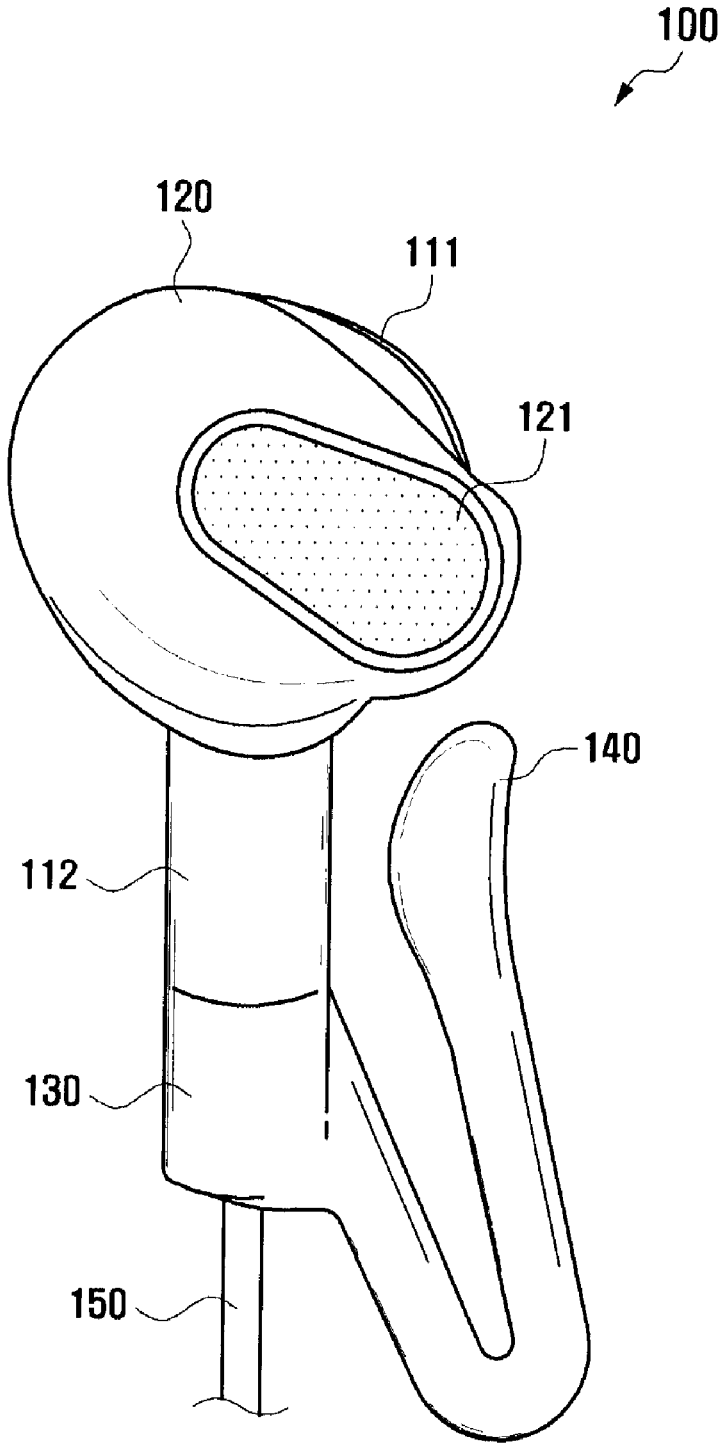
FIG. 2 is a side view of the earphone shown FIG. 1.

FIG. 1 is a front view illustrating a configuration of an earphone according to an exemplary embodiment of the present invention, and FIG. 2 is a side view of the earphone shown in FIG. 1.

Referring now to FIG. 1, an earphone 100 according to the present exemplary embodiment preferably includes a housing 110, protector 120, bushing 130, and under hanger 140. The earphone 100 shown and described can be used with various types of earphone categories, such as an open type earphones, closed type earphones, and a semi-closed type earphone. Further, while in the present exemplary embodiment, only an earphone is described, however the earphone 100 can be applied to various devices that can be used by inserting into a user's ear, such as a headset and/or a wireless headset as well as an earphone.

The housing 110 at least partially encloses a speaker 113 (shown in FIG. 3) therein. The housing 110 is preferably comprised of a silicon material. The housing 110 includes a body 111 for fixing and coupling to the speaker 113 therein and a duct 112 formed at a rear surface of the body 111 to guide an earphone cord 150 connected to the speaker 113 to the inside of the body 111. The duct 112 is formed with an inclined shape at an angle to the body 111 and extends downwards in a substantially vertical direction therefrom. This relationship is described later in detail with reference to FIG. 3.

The protector 120 is installed in/on a front surface of the housing 110 and preferably has a meshed surface 121 for delivering sound from the speaker. The protector 120 is preferably comprised of a cover for relieving a pain (or ear fatigue) occurring when the speaker mounted in the housing 110 is in direct contact with a user's ear 1 (shown in FIG. 3) and is a portion substantially in contact with the ear 1 when inserting the earphone 100 therein. The protector 120 is preferably comprised of a soft and elastic material, such as silicon and elastomer (just to name a few possible examples), and thereby permits the user to experience a comfortable feeling when wearing the earphone 100.

As shown in FIG. 1, the protector 120 in this exemplary embodiment has a shape similar to a hemisphere, but the shape of the protector 120 is not limited thereto and may have, for example, a tubular shape. At least one speaker hole (not shown) may be formed in a side surface of the protector 120 that makes contact with the ear 1, and an external inlet of the speaker hole can be covered with the meshed surface 121, preferably in a dense gauze form. The quantity and size of the at least one speaker hole are determined in consideration of a condition such as a size of the protector 120 and a performance of the speaker 113. The meshed surface 121 performs a function of effectively delivering a sound output from the speaker 113 through the speaker hole to the ear 1.

Although not shown in FIG. 1, a damper for balancing medium and low frequency band sound signals, an equalizer for balancing high frequency band sound signals, or a cloth for balancing a low frequency band sound signals may be installed within the housing 110 and the protector 120.

The bushing 130 is connected to a lower end of the housing 110, specifically, to a lower end of the duct 112 of the housing 110, in order to sustain durability of the earphone 100 by preventing damage thereto caused by frequent movement and winding or bending of the earphone cord 150. It is to be understood and appreciated by the person of ordinary skill in the art that while the earphone depicted in FIG. 1 has a cord 150, it is within the spirit of the invention and the scope of the appended claims that the invention is also applicable to a cordless earphone, which may have an RF unit in lieu of the cord 150.

The under hanger 140 is provided at a lower part of the housing 110 to closely contact along a lower part of the rear side of an earflap 2 (shown in FIG. 4) of the user's ear 1.

In the present exemplary embodiment, the under hanger 140 is detachably connected to the bushing 130 at a lower end of the housing 110. Although not shown in FIG. 1, at a connection portion of the under hanger 140 and the bushing 130, a coupling means such as a groove or a protrusion may be formed. Therefore, the user can use the earphone 100 either with the under hanger 140 attached to the earphone 100, or without the under hanger 140 attached to the earphone 100. For example, when the user is making relatively large or sudden movements, such as when taking exercise, the user can use the earphone 100 with the under hanger 140 attached to the earphone 100, so as to assist the earphone 100 to stay in place. Conversely, when the user is not making such movements, the user can use the earphone 100 without the under hanger 140 attached to the earphone 100.

Alternatively, the under hanger 140 may be integrally formed with the bushing 130 connected to a lower end of the housing 110. A method of connecting the under hanger 140 to a lower part of the housing 110 is not limited to the above-described methods and can be changed.

The under hanger 140 may also adjustably connect to the bushing 130 (or a lower part of the housing 110 if there is not bushing), so as to adjust a degree of closeness of contact with the earflap 2 relative to the connected part of the lower part of the housing 110. For example, the under hanger 140 can be connected to rotate in a vertical direction or a horizontal direction towards the earflap 2 relative to the connected part of the lower part of the housing 110. In this way, by providing a connection to enable adjustment of a degree of closeness of contact with the earflap 2, a position of mounting the under hanger 140 in the earflap 2 can be adjusted according to a user's preference. Also, the amount of expected movement running on pavement versus brisk walking) may also permit the user to adjust the degree of closeness of contact with the earflap. It is also possible, and with in the spirit and scope of the claimed invention, to bias the under hanger toward the earflap, although the amount of biasing may vary over time as the biasing means (such as a leaf spring, for example) could lose some elasticity.

As described above, according to the earphone 100 of the present exemplary embodiment, by providing the under hanger 140 in a lower part of the earphone 100, the earphone 100 can be prevented from being easily separated from the user's ear 1. Further, by using a simple structure of the under hanger 140, an entire structure of the earphone 100 can be simplified and the earphone 100 can have a small size.

The under hanger 140 is preferably constructed of a soft, elastic, and flexible material. Preferably, the under hanger 140 is made of elastomer, however it is not limited thereto and can be made of a material such as silicon, or compounds thereof, such as silicone. As the under hanger 140 is made of a soft and elastic material, the earphone 100 can make close contact with the user's ear and not be considered uncomfortable by the user. By removing an unnecessary space between the earphone 100 and an earhole, a sound quality can be improved and a degree of comfort when wearing the earphone 100 can be improved.

Figure 3:
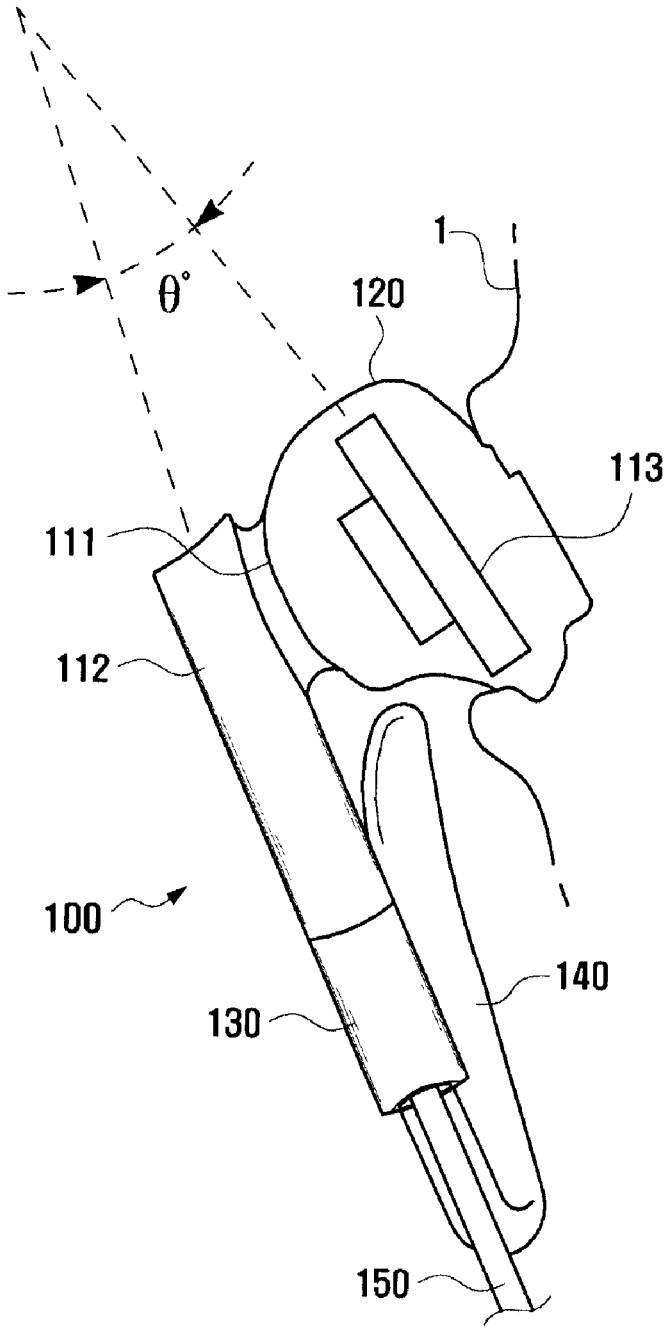
FIG. 3 is a front view illustrating the earphone of FIG. 1 in an inserted state in a user's ear.

FIG. 3 is a front view illustrating the earphone of FIG. 1 in an inserted state in a user's ear.

Referring to FIG. 3, the duct 112 is formed at an inclined angle to the body 111 and extends downwards in a substantially vertical direction therefrom. That is, the duct 112 formed at a rear surface of the body 111 is formed at a predetermined angle relative to the speaker 113 that is fixed and coupled to the inside of the body 111. In the present exemplary embodiment, it is preferable in this exemplary embodiment that the duct 112 is formed at an acute angle θ to the speaker 113, which in this example is about 16.5°. However, the angle θ between the speaker 113 and the duct 112 is not limited thereto and can be determined in consideration of a separation degree of the earphone 100 from the user's ear 1 and a wearing feeling of the earphone 100. By appropriately adjusting the angle θ between the speaker 113 and the duct 112, the earphone 100 can be prevented from being easily separated in a lower direction from the user's ear 1 according to a user's motion and can simultaneously provide a good comfortable feeling to the user particularly when the under hanger 140 is worn.

Figure 4:
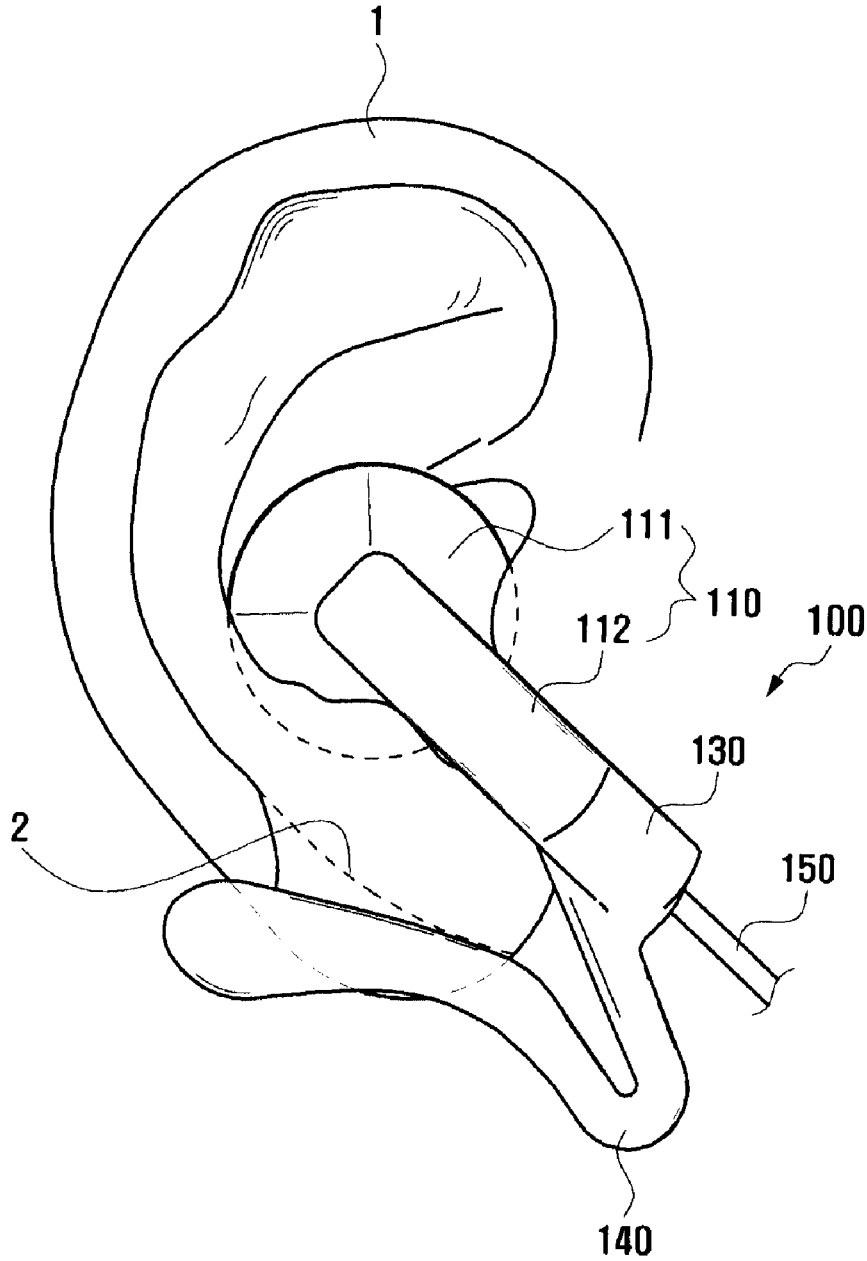
FIG. 4 is a side view of the state of FIG. 3.

FIG. 4 is a side view of the earphone in the inserted state of FIG. 3. Referring now to FIG. 4, because the under hanger 140 provided at a lower part of the housing 110 can closely contact along a lower part of the rear side of the earflap 2, the under hanger 140 prevents the earphone 100 from being easily separated in an upward direction from the user's ear 1 according to the user's motion.

As described in the examples provided herein above, according to the present invention, an under hanger is arranged in a lower part of an earphone, thereby preventing the earphone from being easily separated from a user's ear.

Further, a duct formed at a rear surface of a housing to guide an earphone cord to the inside of the housing is formed at a predetermined angle to a speaker provided within the housing, thereby further preventing the earphone from being easily separated from the user's ear.

Still further, an under hanger made of a soft material is provided so that, as the earphone closely contacts with the user's ear, a sound quality is improved and a wearing feeling of the earphone is improved.

In addition, an under hanger of a simple structure is provided so that an entire structure of the earphone can be simplified and the earphone can be formed in a relatively small size.

Although exemplary embodiments of the present invention have been described in detail hereinabove, it should be clearly understood that many variations and modifications of the basic inventive concepts herein described, which may appear to those skilled in the art, will still fall within the spirit and scope of the exemplary embodiments of the present invention as defined in the appended claims. For example, the under hanger can be biased to provide a predetermined amount of pressure against the ear flap.

What is claimed is:

1. An earphone comprising:

a speaker;

a housing for containing the speaker therein;

a protector installed in a front surface of the housing having a perforated surface for delivering a sound from the speaker;

an under hanger coupled at a lower part of the housing for contact with an earflap of a user; and a bushing coupled to the lower part of the housing, wherein the under hanger is detachably coupled to the bushing.

2. The earphone of claim 1, wherein the under hanger is detachably coupled to the lower part of the housing.

3. The earphone of claim 1, wherein the under hanger contacts an ear of the user along the lower part of the rear side of the earflap.

4. The earphone of claim 2, wherein a coupling portion of the under hanger and the lower part of the housing comprises threads and grooves.

5. The earphone of claim 1, wherein the perforated surface of the protector comprises a mesh surface for delivering a sound from the speaker.

6. The earphone of claim 5, wherein the mesh surface is arranged in a gauze form.

7. The earphone of claim 1, wherein the housing comprises:

a body for fixing and coupling the speaker to an inside of the housing; and a duct formed at a rear surface of the body for guiding an earphone cord connected to the speaker via an inside of the body, wherein the duct is formed at an inclined angle relative to the body and extends downwards in a substantially vertical direction relative to the body.

8. The earphone of claim 7, wherein the duct is formed at an acute angle relative to the speaker.

9. The earphone of claim 8, wherein the acute angle between the speaker and the duct is user-adjustable.

10. The earphone of claim 7, wherein the acute angle comprises substantially 16.5° relative to the speaker.

11. The earphone according to claim 7, wherein the under hanger is biased for making contact with rear side of the earflap of the user.

12. The earphone according to claim 11, wherein the under hanger contacts that the rear side of the earflap of the user sufficient to prevent vibrations from separating the earphone in an upward direction from the user's ear.

13. The earphone of claim 1, wherein the under hanger is adjustably coupled to the earphone.

14. The earphone of claim 1, wherein the under hanger comprises an elastomer.

15. An earphone comprising:

a speaker;

a housing for containing the speaker therein;

a protector installed in a front surface of the housing having a perforated surface for delivering a sound from the speaker; and an under hanger coupled at a lower part of the housing for contact with an earflap of a user, and a bushing coupled with the lower part of the housing, wherein the under hanger is integrally formed with the bushing.

16. The earphone of claim 15, wherein the under hanger is adjustably coupled to the bushing.

* * * * *